United States Patent [19]

Falivene

[11] 4,057,673

[45] Nov. 8, 1977

[54] FABRIC CONDITIONING WITH IMPROVED COMPOSITION CONTAINING A PLASTICIZER

[75] Inventor: Pasquale J. Falivene, Union City, N.J.

[73] Assignee: Colgate Palmolive Company, New York, N.Y.

[21] Appl. No.: 630,605

[22] Filed: Nov. 10, 1975

Related U.S. Application Data

[63] Continuation of Ser. No. 513,238, Oct. 9, 1974, abandoned, which is a continuation of Ser. No. 359,395, May 11, 1973, abandoned, which is a continuation of Ser. No. 82,461, Oct. 20, 1970, abandoned.

[51] Int. Cl.[2] ..... B32B 5/16; B05D 3/12

[52] U.S. Cl. ..... 428/411; 427/242; 428/315; 428/407

[58] Field of Search ..... 428/274, 310, 315, 262, 428/279, 411, 407; 427/242

[56] References Cited

U.S. PATENT DOCUMENTS

| | | | |
|---|---|---|---|
| 1,968,795 | 7/1934 | Bertsch | 252/1 |
| 2,213,477 | 9/1940 | Steindorff et al. | 260/613 |
| 2,936,251 | 5/1960 | Garceau et al. | 428/375 |
| 3,036,130 | 5/1962 | Jackson et al. | 260/584 |
| 3,351,483 | 11/1967 | Miner et al. | 252/8.5 |
| 3,442,692 | 5/1969 | Gaiser | 427/242 |
| 3,501,335 | 3/1970 | Cahn et al. | 252/8.8 |
| 3,554,784 | 1/1971 | Lyness | 252/8.8 |
| 3,686,025 | 8/1972 | Morton | 428/274 |
| 3,743,534 | 7/1973 | Zamora | 427/242 |

*Primary Examiner*—William J. Van Balen
*Attorney, Agent, or Firm*—Norman Blumenkopf; Herbert S. Sylvester; Murray M. Grill

[57] ABSTRACT

The conditioning of fabrics is effected by compositions which comprise a major proportion of conditioning agent and a minor proportion of a plasticizer. The conditioning agent is preferably a surface active fabric softener and the plasticizer is preferably a water soluble liquid, nonionic poly-lower alkoxy or polyhydroxy compound, which improves the transferability of the conditioning agent to fibrous materials during treatment of such materials, by preventing cracking or flaking of the conditioning agent during the treating operation.

Although in some instances the conditioning agent plus plasticizer composition may be used as a solid product alone, without a separate base, it is generally preferred that it be employed as a coating on a base, preferably a form-retaining solid base. Also, it is preferred that the fabric conditioning be practiced on damp laundry in an automatic laundry dryer.

2 Claims, 9 Drawing Figures

FABRIC CONDITIONING WITH IMPROVED COMPOSITION CONTAINING A PLASTICIZER

This is a continuation, of application Ser. No. 513,238 filed Oct. 9, 1974, which in turn is a continuation of Ser. No. 359,395, filed May 11, 1973, which is a continuation of Ser. No. 82,461 filed Oct. 20, 1970, each abandoned.

SUBJECT OF THE INVENTION

This invention relates to the conditioning of fabrics. More particularly, it relates to the employment of a fabric softening and/or antistatic agent with a plasticizer. The plasticizer improves the even transfer of the conditioning agent to the fibrous materials being treated by preventing cracking or flaking off of the conditioning agent at the surface of a conditioning article.

BACKGROUND OF THE INVENTION

In the conditioning of fabrics, such as those in laundry, by tumbling contact of the laundry with a fabric conditioning article, such as a base material containing a coating of conditioning composition, stains and spots have been observed on the treated articles. In some cases, as when cationic conditioning agents, such as quaternary ammonium salts, are employed, staining may be due to a chemical reaction between color bodies or metal ions and the quaternary compound. However, in addition to such staining, spotting has been observed on items of laundry treated in an automatic dryer with conditioning compositions that were transferred to the laundry from the surfaces of a solid treating article. Such spotting, while unobjectionable in certain cases, sometimes is sufficiently pronounced that it significantly adversely affects the appearance and utility of the conditioned article. This is especially true when the materials being conditioned are resin-coated or otherwise treated to make them "permanently pressed". Because most of the fabric conditioning agents of the type described herein are wax-like the waxy or fatty appearing spots on the laundry will be more apparent on colored items than on white goods, since they seem to deepen the colors. Nevertheless, upon ironing, in which the deposited conditioning agent is usually fused and distributed in a smooth film at the surface of the article being ironed, the spot may be enlarged or may be made readily visible and hence, more objectionable, even on white goods. In some cases ironing may "fix" the stain to the substrate.

Chemical analyses of the substances of the spots on the conditioned fabrics establish that they usually correspond substantially to the conditioning compositions being employed. Thus, it would be natural to assume that under the heat of the conditioning operation, usually undertaken in an automatic laundry dryer, the conditioning composition had melted at the surface of the conditioning article and had been smeared onto the fabric contacting it, creating the spots. Consequently, from such an analysis of the problem it would appear that what was required was a hardening agent for the conditioning composition or else, to employ conditioning agents of higher melting or softening points. Also, in the event that the smearing was due to the softening of the conditioning agent in contact with moisture in laundry being treated, it appeared desirable to utilize conditioning agents of lesser degree of water solubility. From these considerations, the employment of a water soluble, liquid plasticizing compound to diminish spotting was contraindicated. Even if plasticizers were considered as being of possible utility to make the conditioning composition more uniform and resilient and to aid in the spreading of the conditioning agent over the fabric with which it is brought in contact, it would be expected that the use of liquid and water soluble material would be avoided, in the interest of diminishing the excessive smearing of the conditioning agent onto the fabric being treated.

DESCRIPTION OF THE INVENTION

Despite the contraindications from the prior art and a reasonable analysis of the problem, it has now been found that the addition to fabric softeners and antistatic agents of a plasticizing agent, generally in minor proportion, improves the uniformity of transfer of such conditioning agents to fabric being treated by tumbling contact with a solid conditioning article under usual automatic laundry dryer conditions of heat and moisture. It seems that the major problems confronted were in the breaking away or flaking off of pieces of conditioning material from the surface of a conditioning article and subsequent fusion of the conditioner pieces onto the material being treated. The use of a liquid plasticizer has significantly improved the surface characteristics of the conditioning composition and has prevented such breaking away of flakes or pieces of conditioning agent, without objectionably softening the conditioning composition to the point where it fuses onto the fabric in lumps or smears which would create spots.

In accordance with the present invention there is provided a solid state composition for use in conditioning fibrous materials to make them soft and/or static-free which comprises a surface active conditioning agent, of either nonionic, anionic or cationic type, plus a plasticizing agent, present in sufficient quantity to improve the transferability of conditioning agent to fibrous material during treatment of the fibrous material with the conditioning composition in an automatic laundry dryer. Transferability is improved by the plasticizer preventing cracking or flaking off of the fabric conditioner during tumbling contact of the material to be conditioned with the solid state conditioning agent. Also within the invention are an article for conditioning fibrous materials which comprises a solid state composition of the type mentioned on a solid base, preferably of the form-retaining type and a method of conditioning fibrous materials utilizing such compositions and articles.

In preferred embodiments of the invention, the conditioning agents employed are nonionic or anionic, the plasticizing agent is a liquid, nonionic poly-lower alkoxy or polyhydroxy compound, it is present in a minor proportion, from 1 to 25% of the conditioning composition and conditioning is of damp laundry in an automatic laundry dryer of the tumbling drum type.

Various objects, details, constructions, operations, uses and advantages of the invention, in its various aspects, will be apparent from the following description, taken in conjuntion with the illustrative drawing of some embodiments thereof, in which drawing:

THE DRAWING

DETAILED DESCRIPTION OF THE INVENTION

Figure 1:
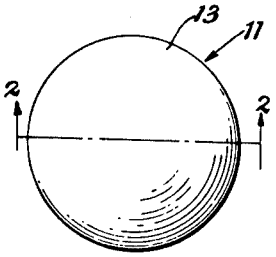
FIG. 1 is a top plan view of a fabric conditioning article coated with fabric conditioning composition.
Figure 2:
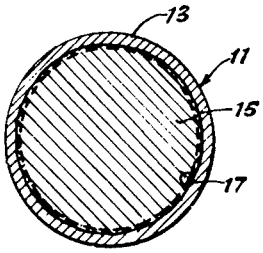
FIG. 2 is a central vertical sectional view along plane 2—2 of the article of FIG. 1, showing the coating composition on a polystyrene foam base.
Figure 3:
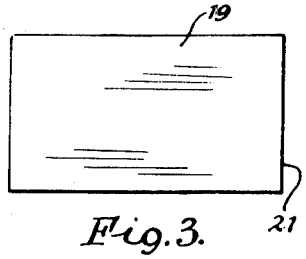
FIG. 3 is a top plan view of a coated paper conditioning article.

Spherical fabric conditioning article 11, shown in FIG. 1, comprises a form-retaining polystyrene foam base 15 coated with fabric softening and antistatic composition 13. As will be noted from FIGS. 1 and 2, the coating is smooth and continuous over the surface of the polystyrene sphere 15 and penetrates below said surface, as illustrated at 17, to better hold the coating to it. In FIG. 3 is shown a similar fabric conditioning article, in which the conditioning composition 19 is deposited on both sides of a paper base 21. FIGS. 1–3 represent both the articles and compositions of the present invention, containing a plasticizing ingredient. and also, when the plasticizer is omitted from the coating, represent control articles.

Figure 4:
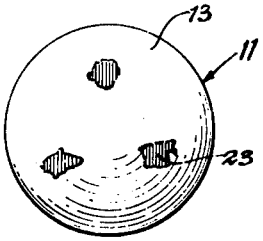
FIG. 4 is a top plan of the article of FIG. 1, without plasticizer in the conditioning composition, after being subjected to automatic dryer conditions, illustrating the flaking off of particles of coating conditioning composition therefrom.
Figure 5:
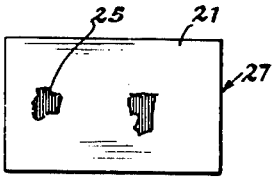
FIG. 5 is a top plan view of an article of FIG. 3, after subjection to dryer conditions, illustrating the flaking off of unplasticized conditioning composition therefrom.
Figure 6:
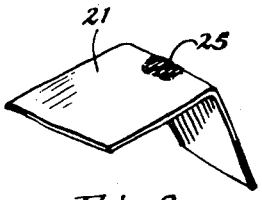
FIG. 6 is a perspective view of the article of FIG. 5, illustrating the bending thereof which promotes removal of unplasticized conditioning composition.

In FIG. 4, the coating 13 of conditioning composition is one not containing plasticizer. Accordingly, during subjection of the spherical conditioning article to the automatic laundry dryer conditions, wherein it is contacted against the metal interior walls of a dryer and flights thereon, sections of coating are removed as flakes, leaving voids 23. Similar voids 25 are shown on conditioning article 27 of FIG. 5. The bending which strains unplasticized coating composition 21 so as to cause the flaking off of coating composition and the creation of voids, such as that at 25, is illustrated in FIG. 6. Such bending may be caused by entrapment of a flexible article between items of laundry.

Figure 7:
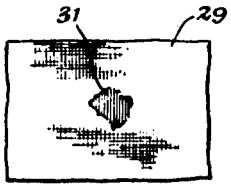
FIG. 7 is a view of a portion of conditioned fabric, showing the deposit thereon of a flake of unplasticized conditioning material.
Figure 8:
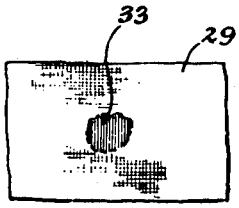
FIG. 8 is a view of the fabric of FIG. 7, after melting and partial spreading of the unplasticized conditioning composition, due to subjection to the heat of an automatic dryer.
Figure 9:
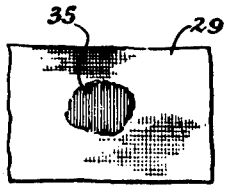
FIG. 9 is a view of the same fabric, after ironing of the portion thereof containing a deposit of unplasticized conditioning composition.

In FIG. 7 is shown a piece of laundry or fabric 29 on which there has been undesirably deposited a flake 31 of unplasticized conditioning material, which had been removed from the conditioning article during a treating operation. The same fabric, with the deposit 33 having been fused into the fabric over a larger area by dryer operation is illustrated in FIG. 8. Similarly, a further enlarged spot 35 is apparent after ironing of article 29.

Although it is within the broad contemplation of the present invention that fabric conditioning compositions are improved by the incorporation therein of plasticizers and are then better usable for the treatment of textiles to soften them, make them antistatic or give them other desirable properties, usually such compositions will be most beneficial when employed on a conditioning article as a coating on a base or substrate, preferably one of form-retaining material. When they are used as coatings on flexible bases, such as paper or cloth, the advantage of the plasticizer content is most significant, because of the bending and folding such materials normally encounter in use, with the resultant strains on unplasticized conditioning coatings that tend to make them crack or flake off onto the fabrics being treated.

Of the form-retaining bases that are coated, it will be preferred to employ those which are of low densities, such that the calculated density will be on the order of from 0.1 to 2 grams/cubic centimeter, preferably from 0.2 to 0.5 g./c. cm. Such materials include various woods, composition boards, paperboards, light minerals, rubbers and synthetic organic polymeric plastics, preferably foamed plastics such as polyurethanes, polyesters, polystyrenes, polyvinyl chlorides or nylons. Such items may be formed by various means including folding, molding, cementing, fusing, stapling and interlocking of parts to make the final desired shape. Normally, to diminish strains on the coating agent, sharp corners will be avoided on the base to be coated. Instead of using form-retaining materials, flexible substrates, such as sheet materials of paper, cloth, sponge, rubber, synthetic organic polymeric plastics and similar materials may be used. These will also generally be light in weight and will usually be of thicknesses from 0.001 to 1 cm., preferably from 0.003 cm. to 0.1 cm. The volumes of the form-retaining articles will normally be from 5 to 500 c. cm., preferably from about 10 to 100 c. cm., while the sizes of the sheet materials or flexible substrates will usually be from 50 sq. cm. to 2,000 sq. cm., preferably from 100 sq. cm. to 1,000 sq. cm.

Among the fabric softeners and antistatic agents that are usable in accord with the present invention are the nonionic surface active materials, including higher fatty acid mono-lower alkanolamides, higher fatty acid di-lower alkanolamides, block copolymers of ethylene oxide and propylene oxide, having hydrophilic and lipophilic groups, alkyl (preferably middle alkyl) phenol poly-lower alkylene oxide lower alkanols, polymers of lower alkylene glycols, polyalkylene glycol ethers of higher fatty alcohols and polyalkylene glycol esters of higher fatty acids. Among the anionic agents are the higher fatty acid soaps of water soluble bases, higher fatty alcohol sulfates, higher fatty acid monoglyceride sulfates, sarcosides, taurides, isethionates and linear higher alkyl aryl sulfonates. Cationic compounds include the higher alkyl di-lower alkyl amines, di-higher alkyl lower alkyl amines and quaternary compounds, expecially quaternary ammonium salts, e.g., quaternary ammonium halides. In the preceding description, lower, as applied to various hydrocarbyl-containing groups, indicates a carbon content of from 1 to 6, preferably from 2 to 3. Similarly, higher includes compounds having from 10 to 20 carbon atoms, preferably from 12 to 18. Of course, since it is important to the present invention that the conditioning composition be in a solid form, so that it can have conditioning agent gradually removed from it by contact with tumbling laundry fabrics in a dryer or similar machine, the fabric softening and/or antistatic agents will be chosen to be in the solid state. Nevertheless, surface portions may be softened or dissolved during use. In the event that compositions are found which are satisfactorily form-retaining for applications to material to be conditioned, while still being sufficiently plastic under dryer conditions to avoid cracking, they may not require the presence of the plasticizing agents of this invention for improved effects or may require lesser proportions thereof than other comparable more rigid fabric treating compositions. Normally, however, the fabric conditioning agents are solid state materials which can benefit from the addition of the plasticizers.

Specific examples of surface active materials of the types described above are given in Volume II of the text, Synthetic Detergents, by Schwartz, Perry and Berch, published in 1958 by Interscience Publishers, New York. See pages 25 to 143. Among the more preferred of these are:

Nonionic — nonylphenoxy polyethoxy ethanol; stearic monoethanolamide, lauric monoethanolamide, block copolymers of ethylene oxide and propylene oxide (Pluronics ®), Anionic — sodium soap of mixed coconut oil and tallow fatty acids; sodium stearate; potassium stearate; sodium laurate; tallow alcohols sulfate;

Cationic — dilauryl dimethyl quaternary ammonium chloride; hydrogenated tallow alkyl trimethyl ammonium bromide and benzethonium chloride.

In the recitation of conditioning agents given above, there are included compounds whose utility as conditioning agents in automatic laundry dryer processes such as those described herein were discovered by others. It is to be understood that the present invention is of the incorporation of a plasticizer in such compositions to improve their properties. The invention is generally applicable to all solid state conditioning compositions used in such processes and it is considered unnecessary to recite here the host of conditioning agents that can be improved by this method.

The plasticizers that are used are highly preferably liquids but it may sometimes be desirable to replace part or, in some circumstances, all of the liquid state plasticizer with one which is a solid but has the properties of a liquid or near-liquid in combination with the conditioning agent or mixture of agents employed. Thus, the materials normally known to have plasticizing properties for various solids are useful, providing that under the conditions of the dryer, they sufficiently plasticize or soften the conditioning composition or make it resilient so as to impove its resistance to cracking and flaking.

Of the plasticizing agents it is preferred to use those which are water soluble and liquid at room temperature, or 25° C. Although not as useful to make the best conditioning compositions, plasticizers which are oil or alcohol soluble and which are solids at room temperature may be used in appropriate circumstances. With respect to the solid plasticizers, those which soften or liquefy under the slightly elevated temperatures of initial dryer conditions are best. Of course, the plasticizers should be chosen so that the most desired effects are obtained with the particular compositions employed. For example, an anionic plasticizer would not normally be used with a cationic conditioning agent nor would a near-solid plasticizer be employed with a very rigid solid state conditioning agent. Although by following the guide lines previously given, a wide variety of plasticizing materials may be used to improve the present conditioning agent, normally there will be employed liquid, colorless, water soluble, nonionic materials, generally of comparatively low molecular weight, e.g., from 100 to 1,000, preferably 100 to 500. These will normally be poly-lower alkoxy or polyhydroxy compounds, wherein the lower alkylene oxide or hydroxy groups contribute water solubility and liquid characteristics. Most preferably, the alkoxy groups will be ethoxy, and generally the number present will be from 2 to 20 per molecule. For the polyhydroxy compounds, there will usually be present from 2 to 6 hydroxyls.

Representative of the polyoxyethylene glycol derivatives are the alkyl phenyl polyoxyethylene ethanols wherein there are present 2 to 20 ethoxy groups per molecule. The alkyl may be from 1 to 20 carbon atoms and there may be several alkyl groups on the phenyl ring. Generally, there will be no more than 3 alkyl groups and usually they will be of 6 to 12, preferably from 7 to 9 carbon atoms. The chain length of the polyoxyethylene moiety will normally be chosen to make the compound water soluble. Thus, with a single octyl or nonyl group on the phenyl, there will usually be present from 5 to 10 ethoxy groups on the side chain. Another class of liquid plasticizer is that of the polylower alkylene glycol type, preferably polyethylene glycol of 2 to 20 ethoxy groups per molecule. Often, such compounds will have a multiplicity of free hydroxyl groups to give them water solubility. In some instances, poly-lower alkylene glycol may comprise a mixture of ethylene and propylene glycol moieties, either randomly distributed or as blocks, with it being preferred that the proportion of the lower alkylene oxide present should be great enough to impart water solubility. Yet, providing that there is a sufficient balance of hydrophilic groups in the molecule to impart a hydrophilic character to it, compounds of this type in oil form, such as the Ucons ®, may be used if they are hydrophilic enough to be readily distributed over the fabric with the conditioning agent.

Of the polyhydroxy compounds that are useful, the most preferred is glycerol, although propylene glycol, ethylene glycol and similar diols and triols are also good plasticizers. All such materials, including other suitable polyols, are liquids and have hydrophilic properties. In combination with the solid state fabric softeners and antistatic agents, they produce strengthened compositions which are more resistant to strains than the unplasticized conditioning agent. In some circumstances, liquids which do not possess hydrophilic natures are useful and of these the mineral oils, esters, e.g., phthalates, sebacates, ketones and acids are acceptable, usually in very minor proportions, providing that they are readily distributed with the conditioning agent and, in such formulas, do not spot or stain the fabric. The esterified di-carboxylic acids, such as the sebacates, will normally possess substantially terminally located carboxyl groups and intermediate alkylene chains, usually of from 4 to 10 carbon atoms. The esterifying alcohols will generally be of from 3 to 10 carbon atoms. Of these compounds, dibutyl sebacate, dioctyl phthalate and dioctyl sebacate are preferred.

Of course, to be a satisfactory plasticizer, the vapor pressure of the liquid should be low enough so that it will not be lost by evaporation during storage of the treating composition or article. Again, as was mentioned before, solid materials that liquefy at the slightly elevated temperatures of the initial drying period may be used. Among these may be mentioned the fatty acids and alkoxylated fatty acids or hydroxy fatty acids. It has been noted that although some higher fatty acids are not really plasticizers, having melting points that are too high, when they are compounded with various conditioning agents of a more friable type, they contribute to stengthening of the compositions and thereby help to prevent excessive spotting and staining of treated articles.

In addition to the fabric softening and/or antistatic agents and plasticizers in the present compositions, other components may also be present for their adjuvant effects. Thus, other conditioning agents may be used, including those designed to treat the fabrics in other ways than in softening. For example, perfumes, brighteners, bactericides, solvents, thickening or hardening agents, stabilizers and other materials may be incorporated in the conditioning compositions. In some cases, small quantities of water may be present, especially when the components form hydrates. The types and proportions of such adjuvants used will be chosen to be readily applied with the softening agents and will not interfere with their operation.

The final conditioning composition is preferably waxy in appearance and is capable of being stored at room temperature without melting, while yet being satisfactorily picked up by fabrics in the operation of an automatic laundry dryer, when the fabrics tumble into contact with the conditioning composition. The conditioning composition will be form-retaining at temperatures below 30° C. and preferably, also at all temperatures below 40° C. It may tend to fuse or melt under the higher temperatures obtained in the dryer, such as 70° to 90° C. but usually will be only sufficiently softened, even in the presence of the plasticizers, to be abraded off a treating article onto the surface of material to be conditioned, at dryer conditions, including the presence of moisture and drying gas at an elevated temperature. The conditioning composition should be removable from a substrate at a regular rate and in sufficient quantity to condition fabrics, at a temperature from 40° to 90° C., preferably from 50° to 80° C. Normally, to effect these purposes, the fabric softener and/or antistatic agent, the surface active conditioning agent mentioned previously, will be a major proportion of the conditioning composition, usually from 51 to 99% thereof. Preferably it will comprise from 75 to 95% of the composition. The plasticizer will be from about ½ or 1 to 25% of the composition, preferably from 5 to 20% thereof. Other adjuvants, such as those previously mentioned, may be present to make up the balance of the composition and usually this will total from 0 to 48%, preferably from 5 to 20% thereof.

When the conditioning composition is employed as a coating on the substrate, the thickness of the coating applied will normally be within the range of 0.0005 to 0.5 centimeter, generally from 0.002 to 0.3 cm. and preferably from 0.003 or 0.01 to 0.1 cm. The thickness given is that external to the outer surface of the object coated. A somewhat porous or rough surfaced object or one having identations will normally be preferred so that the coating composition may penetrate below the outer surface to a sufficient depth to hold the external coating firmly to the surface and prevent its cracking or flaking off from the surface during use. In addition to the plasticizer helping to prevent cracking and flaking, it also aids in the penetration of the pores or openings in the surface of the substrate and thereby assists in holding the coating to the base. A minor proportion of the external thickness of coating agent may be below the surface. This will usually be held to 10 to 30% of that external to the base. In terms of weights applied, the conditioning composition will normally be employed in the range of 0.0005 to 0.5 g./sq. cm., preferably from 0.002 to 0.3 g./sq.cm. and most preferably from 0.01 to 0.2 /sq. cm., with 0.5 to 15 grams used per 5 to 10 pounds of laundry.

The manufacture of the present compositions is relatively simple. Usually, a melt of the various constituents may be prepared or, if desired, a solvent may be used to dissolve or disperse all of them. The choice will depend upon the method of applying the composition to a substrate. In the event that the composition is employed as a solid or is used later to cost other bases, it may be made by either the fusion or dissolving methods, followed by solidification by cooling or evaporation of solvent. Alternatively, mere physical mixing may be employed. The use of melts and the advantages of these in the coating of substrates are described in the patent application entitled *PROCESS FOR THE MANUFACTURE OF FABRIC CONDITIONING ARTICLE,* filed by me on the same day as the present application. When melts are employed the surface will be cooled soon after application of the desired thickness of conditioning agent. When solutions are used, the solvent contents thereof will normally be from 20 to 80%, preferably from 20 to 40%, and solvent will be evaporated almost immediately after application. It is not necessary to completely dissolve all the constituents of the conditioning composition, so long as they are satisfactorily dispersed. The application of the conditioning composition is made to the desired depth on the base employed in either a single step or plural step application, with solidification of the coating between steps. Penetration of the surface of the base may be regulated by adjusting the composition viscosity or by modifying the nature of the base surface. Preferred methods for coating solids, such as spheres, include spraying and rolling and sphere in a shallow pan of coating composition. When coating flexible items such as paper, roll coating, dip coating, or spray coating may be used. Care will normally be taken to limit the penetration of the depth coating below the surface of the article being coated and to prevent impregnation thereof, inasmuch as the internally located conditioning composition often will not be useful because it cannot be abraded off the conditioning article by the tumbling fabrics contacting it.

The present compositions and articles are simple to employ and the treating methods are effective for conditioning fabrics without special care being necessary on the part of the user. The conditioning article is placed in the automatic dryer or other tumbling device immediately before a drying or treating operation commences. In tumbling, the laundry moves past the conditioning article and the combination of abrading action, heat and moisture causes the deposit of conditioning agent on the fabrics. Although it is preferred to employ an automatic laundry dryer, equivalent machines may be used and in some instances the heat and drying air may be omitted for part or all of the cycle. Generally, air will be employed and will be circulated frequently. Normally there will be about 5 to 50 changes of drying gas in the dryer drum per minute and the gas temperature will be from 10° to 90° C., preferably from 50° to 90° C. The dryer will usually revolve at about 10 to 100 revolutions per minute, preferably 20 to 60 r.p.m. The weight of laundry employed will usually be from 4 to 12 pounds, preferably from 5 to 10 pounds, dry weight. This will fill 10 to 70% of the volume of the dryer, preferably about 30% to 60% thereof. Drying will usually take from 5 minutes to 2 hours and generally from 20 minutes to 1 hour will be sufficient, with synthetic fabrics, such as nylon, polyesters and synthetic-natural blends requiring shorter periods of time than cotton laundry. The synthetics may often be dried satisfactorily in from 3 to 10 minutes and resin-treated fabrics of the permanently pressed or non-wrinkling types may be dried in from 10 minutes to ½ hour.

After completion of the drying of the laundry or the softening operation, the conditioning article is removed and examined. If sufficient softener remains, the article may be employed again until complete removal of the coating. If the laundry is not satisfactorily conditioned, additional tumbling may be in order. To obtain different levels of conditioning activity or different effects there may be employed several treating articles or a plurality of different treating articles. Of course, after the coating is consumed the bases may be discarded. Otherwise, additional coatings may be applied to them and the articles can be used again. The coating compositions may be marketed as mixtures, solidified melts or in appropriate solvents, so as to enable the user to recoat the bases, if desired. Other details about the use of the present compositions, articles and methods may be found in an application for patent entitled *FABRIC CONDITIONING METHODS, ARTICLES AND COMPOSITIONS,* filed by G. T. Hewitt, et al. on the same day as the present application, as well as in my other patent application, previously mentioned.

Although the principal advantages of the present invention reside in the avoidance of spotting of the treated fabrics, caused by flaking off of pieces of conditioning composition and subsequent fusing thereof onto the treated fabric, other advantages also result from utilization of this invention. As was mentioned, the plasticizers help the conditioning agent to penetrate better under the surface of the substrate, thereby better holding the coating and preventing flaking, in addition to making the coating itself more resilient and less apt to crack upon subjection to strain or shock. The hydrophilic plasticizers, especially those which are of good water solubility, assist in smoothly removing the conditioning composition from the article and in aiding it to make good contact with the fabric to be treated. Once deposited on the fabric, the plasticizers help to spread it more evenly over the surface. They do this without contributing objectionable properties to the conditioning article or composition. So even if a smear, lump or flake is deposited, the plasticizer helps to distribute it and improves the appearance of the treated fabrics.

The following examples are provided to illustrate the various embodiments of the invention. Unless otherwise indicated, all parts are by weight, temperatures are in degrees Centigrade and the measurements are in the metric system. It should be borne in mind that the examples are only intended to be illustrative of the invention and do not limit its scope. For example, although the particular active ingredients disclosed may be employed best, those which are obvious modifications thereof (chemically different but physically equivalent, as in substituted alkyl phenyl polyoxyethylene ethanols) or otherwise equivalent (other plasticizers), are also within the scope of the invention.

EXAMPLE 1

| | Parts by weight |
|---|---|
| Stearic monoethanolamide (from hydrogenated tallow fatty acids) | 90.0 |
| Nonyl phenoxy polyoxyethylene ethanol of 5 oxyethylene groups (Triton N 101, mfd. by Rohm and Haas, Inc.) | 10.0 |

EXAMPLE 1-continued

| | Parts by weight |
|---|---|
| | 100.0 |

A melt of the above composition is prepared and is used to coat a foamed polystyrene sphere having a diameter of 10 cm. The sphere is made by cutting to shape from slabs of polystyrene foam board and has the rough edges thereof rounded off, to prevent snagging with clothing in an automatic laundry dryer treatment. The styrofoam sphere is coated with a melt of the above composition to a depth of 0.05 cm. above the surface of the styrofoam and penetrates to a depth of about 0.01 cm. below that surface. The density of the sphere is approximately 0.3 g./c. cm. and the weight of conditioning composition applied to it is about 18 grams. The coating is effected by rolling the sphere evenly in a shallow pan containing the melted coating agent and immediately after application, cooling the coating to solidify it.

The conditioning action of the article made is tested by employing it in conditioning a dryer load of 8 pounds of mixed laundry in an automatic laundry dryer. The laundry treated is a mixture of wearing apparel and household articles, including cotton, synthetic fibers, especially polyesters, polyacetates and blends of these plastics with each other or with cotton, nylons, rayons and resin-treated, permanently pressed and wrinkle resistant fabrics. The wash comprises approximately 50% of cotton articles, 20% of polyester-cotton blends, 10% permanently pressed items, 10% nylon articles and the balance of rayon, acetate, etc. The dryer employed is of the horizontal drum type, having longitudinal flights or ridges to assist in creating a tumbling action. After loading the damp laundry, just removed from a washing machine after having been spun "dry", the conditioning sphere, containing a coating of conditioning agent, is placed on top of the laundry, which occupies 40% of the dryer volume, and the dryer operation is commenced. Drying air is blown through the dryer at the rate of about 200 cubic feet per minute and with an initial temperature of about 70° C. The drum rotates at about a speed of 60 r.p.m. Initially the temperature of the damp laundry is low, approximately 20° C., but as drying continues, it increases to almost 80° C. The conditioning agent on the surface of the sphere is abraded off onto the surfaces of the fabrics being treated, so that when, after 50 minutes of drying, the machine is turned off and the laundry is removed, it is static-free and feels delightfully soft to touch, compared to a similar load in which the tumbling sphere is not used. Of course, no softening agent is employed in the rinse water during the was cycle. The clothing treated exhibits no spots or stains and periodic examination of the conditioning article during the operation of the dryer shows that the plasticizer satisfactorily enables the coating to be held to the base. There is no flaking or cracking of the conditioning composition evident.

Upon removal of the polystyrene foam ball, it is examined. It is found that approximately 3 grams of conditioning composition have been removed from the surface. Therefore, the ball contains additional active ingredient and can be used again. It is reused with other loads of laundry until all the coating is abraded from the surface. At that point, only about 3 grams of the original 18 grams of conditioning composition remain on the ball. In additional runs, using the same type of base and with the same coating, nylon articles are removed after 5 minutes and permanently pressed articles are removed after 15 minutes. Even the diminished treatment times employed are effective to make the fabrics antistatic and soft and they are wrinkle-free. When, in such runs, the nonyl phenol polyoxyethylene ethanol constituent is omitted from the fabric treating coating, the coating tends to crack and flake and on occasion, spots the clothing being treated, especially the permanently pressed articles.

When, instead of the formation shown above, there is employed 95% of stearic monoethanolamide and 5% of nonyl phenol polyoxyethylene ethanol, the softening effects are not quite as good as these obtained with the above composition but there is no spotting of laundry apparent, either. The coating in such case does not appear to be as strong or resilient as that described above. Also, when 50% of stearic monoethanolamide and 50% of nonyl phenol polyoxyethylene ethanol are used, softening is appreciably diminished and some spotting is apparent.

Effects corresponding to those mentioned herein are also obtained when the conditioning composition is modified to include other lower alkanolamides of higher fatty acids, and mixtures thereof, anionic softening agents, such as soap or sodium lauryl sulfate, or cationics, such as distearyl dimethyl ammonium chloride. Similarly, the plasticizer may be changed to a lower alkylene or polyalkylene glycol, such as propylene glycol or polyethylene glycol, glycerol, or dibutyl sebacate, to also obtain improved conditioning composition effects. However, for most of the plasticizers, except for esterified sebacates and similar esters, at least 1% of plasticizer should be present and preferably, from 5 to 20% thereof.

EXAMPLE 2

The procedure of Example 1 are employed, except that the conditioning composition is applied as an alcoholic solution, comprising 30% ethanol, to paper sheeting having a thickness of about 0.005 cm., which is thus impregnated with conditioning composition at the rate of 3 grams thereof per thousand sq. cm. The paper sheets are approximately 20 × 25 cm. and the thickness of conditioning composition below the surfaces thereof is about 0.001 cm.

Despite the fact that the flexible paper is much more readily distortable than is the polystyrene sphere of Example 1, when employed in the dryer under the same conditions as specified in the preceding example, conditioning compositions on the paper are strengthened by the presence of the nonyl phenol polyoxy ethylene ethanol or other suitable plasticizer and do not flake off or crack. Thus, no spotting or staining of treated fabrics is noted. When similar products are used, without plasticizer in the conditioning composition, occasionally some of the papers become twisted in such manner as to cause pieces of conditioning composition to be deposited in flakes or sections on fabrics to be treated, creating an objectable spotting or staining.

As is the case in Example 1, when others of the named conditioning plasticizing materials are employed instead of those of the 90:10 formula of Example 1, including compositions in which proportions are varied as is indicated in that example, similar good conditioning results are obtained, wherein the articles treated are made soft, static-free and wrinkle resistant.

EXAMPLE 3

| | Parts by weight |
|---|---|
| Sodium soap of a mixture of fatty acids (75% tallow, 25% coconut oil acids) | 15.0 |
| Stearic monoethanolamide | 84.5 |
| Dioctyl sebacate | 0.5 |

The above composition is melted and applied to both polystyrene foam spheres and 20 cm. × 25 cm. papers, as a melt, producing coatings about 0.002 cm. thick on the base papers and about 0.1 cm. thick in the case of the spheres. Penetration is about 25% of the exterior layer of conditioning composition.

When used to treat laundry in the manner described in Example 1, the products are non-flaking and do not spot the laundry. Yet, they condition it very satisfactorily, making it soft and static-free. When the amount of dioctyl sebacate is increased or when it is replaced by other dialkyl polybasic alkanoic acids, similar good results are obtained. Such results also obtain when various other combinations of the previously mentioned conditioning agents and plasticizers are employed. Of course, efforts will usually be made to find the most desirable compositions, which condition best and do not spot materials being treated.

EXAMPLE 4

78% of stearic monoethanolamide, 10% of nonyl phenol polyoxyethylene ethanol and 12% of a 50—50 coco-tallow sodium soap are employed, either as a melt or in alcoholic solution, to treat form-retaining and flexible bases. Excellent softening is obtained with no staining at all under the conditions described in Example 1. Of course when other dryer conditions are employed, providing that the drying gas temperature is within the range of from 40° to 90° C., preferably from 50° to 80° C., and the tumbling time if from 3 minutes to 2 hours, good conditioning and no spotting or staining is also experienced.

What is claimed is:

1. An article for conditioning fibrous materials by treating them with a conditioning composition which comprises a solid base, at least one side of said base coated with a continuous coating of a conditioning composition comprising a major proportion of nonionic, anionic or cationic surface active conditioning agent and from ½ to 25% by weight of conditioning composition of plasticizing agent selected from the group consisting of water soluble alkyl phenyl polyoxyethylene ethanols containing from 2 to 20 oxyethylene groups, the alkyl containing from 6 to 12 carbon atoms, water-soluble poly -($C_2$ – $C_3$) - alkylene glycols having from 2 to 20 $C_2$ – $C_3$ alkoxy groups per molecule, lower alkyl polyols of 2 to 6 hydroxy groups per molecule and esterified dicarboxylic acid containing substantially terminally located carboxyl groups and an intermediate alkylene chain of from 4 to 10 carbon atoms, said acid being esterified with $C_3$ – $C_{10}$ alcohol and wherein from 10 to 30% of the thickness of said composition penetrates said base said plasticizing agent improving the transferability of the conditioning agent to the fibrous materials by preventing cracking or flaking off of conditioning agent from the base during a conditioning operation in which the conditioning article is in control with tumbling fibrous materials for a time long enough to apply a sufficient amount of conditioning composition to such materials to condition them.

2. An article according to claim 1 wherein the conditioning composition comprises a fabric softening or antistatic agent and the plasticizing agent is a liquid at 25° C.

* * * * *